US009162339B2

(12) United States Patent
Zhang

(10) Patent No.: US 9,162,339 B2
(45) Date of Patent: Oct. 20, 2015

(54) ADAPTIVE UNIFORM POLISHING SYSTEM

(71) Applicant: STMicroelctronics, Inc., Coppell, TX (US)

(72) Inventor: John H. Zhang, Altamont, NY (US)

(73) Assignee: STMicroelectronics, Inc., Coppell, TX (US)

( * ) Notice: Subject to any disclaimer, the term of this patent is extended or adjusted under 35 U.S.C. 154(b) by 22 days.

(21) Appl. No.: 14/035,281

(22) Filed: Sep. 24, 2013

(65) Prior Publication Data

US 2015/0087205 A1 Mar. 26, 2015

(51) Int. Cl.
*B24B 37/005* (2012.01)
*B24B 27/00* (2006.01)
*B24B 49/04* (2006.01)

(52) U.S. Cl.
CPC ..... *B24B 37/005* (2013.01); *B24B 27/0076* (2013.01); *B24B 49/04* (2013.01)

(58) Field of Classification Search
CPC .. B24B 21/008; B24B 27/0076; B24B 37/04; B24B 37/005; B24B 49/02; B24B 49/04
USPC ..... 451/5, 8, 10, 11, 65, 66, 285, 287, 288, 451/290, 362
See application file for complete search history.

(56) References Cited

U.S. PATENT DOCUMENTS 1,375,129 A * 4/1921 Carrie ..... 451/271
1,684,029 A * 9/1928 Howard ..... 451/41
2,033,034 A * 3/1936 Knaff ..... 451/271
2,074,111 A * 3/1937 Heichert ..... 451/271
2,948,087 A * 8/1960 Caton ..... 451/271
3,874,123 A * 4/1975 Hopkins et al. ..... 451/271
4,128,968 A * 12/1978 Jones ..... 451/5
5,105,583 A * 4/1992 Hammond et al. ..... 451/271
5,931,722 A * 8/1999 Ohmi et al. ..... 451/271
6,113,472 A * 9/2000 Rosa ..... 451/49
6,312,316 B1 * 11/2001 Takahashi et al. ..... 451/41
6,380,086 B1 * 4/2002 Robinson et al. ..... 438/692
6,645,043 B1 * 11/2003 Yenawine ..... 451/5
7,500,905 B2 * 3/2009 Iga ..... 451/57
2001/0008826 A1 * 7/2001 Ishizaki et al. ..... 451/5
2007/0099546 A1 * 5/2007 Jespersen ..... 451/11
2009/0124180 A1 * 5/2009 Chacich ..... 451/260

* cited by examiner

*Primary Examiner* — Timothy V Eley
(74) *Attorney, Agent, or Firm* — Seed IP Law Group PLLC; Marian Silberstein

(57) ABSTRACT

An adaptive uniform polishing system is equipped with feedback control to apply localized adjustments during a polishing operation. The adaptive uniform polishing system disclosed has particular application to the semiconductor industry. Such an adaptive uniform polishing system includes a rotatable head that holds a semiconductor wafer, and a processing unit structured to be placed in contact with an exposed surface of the wafer. The processing unit includes a rotatable macro-pad and a plurality of rotatable micro-pads that can polish different portions of the exposed surface at different rotation speeds and pressures. Thus, uniformity across the exposed surface can be enhanced by applying customized treatments to different areas. Customized treatments can include the use of different pad materials and geometries. Parameters of the adaptive uniform polishing system are programmable, based on in-situ data or data from other operations in a fabrication process, using advanced process control.

22 Claims, 10 Drawing Sheets

ADAPTIVE UNIFORM POLISHING SYSTEM

BACKGROUND

1. Technical Field

The present disclosure generally relates to the use of mechanical polishing and systems and methods therefor. In particular, the systems and methods disclosed are applicable to chemical-mechanical planarization (CMP) of semiconductor wafers and improving wafer-scale uniformity of CMP processes.

2. Description of the Related Art

CMP is a combination chemical and mechanical polishing technique used in the semiconductor industry to planarize the surface of a semiconductor wafer at various times during an integrated circuit fabrication process. Typically, it is desirable to planarize the wafer surface after completing deposition and patterning of one or more film layers, before proceeding to deposit a next layer of material. If planarization is omitted, uneven surface topography of the un-planarized surface can be transferred to, or accentuated in, subsequent layers.

Such non-uniform topography effects are more likely to occur if materials used in subsequent layers are conformal to the wafer and thus do not evenly fill surface recesses.

Non-uniform topography may occur on three different scales: wafer scale, die scale, and feature scale. Wafer-scale topography results from radial variation in the CMP process, from the center of a semiconductor wafer to the edge of the wafer. Wafer-scale topography can be addressed by adjusting CMP equipment parameters or materials used in the CMP process itself, so that, following a CMP step, the film thickness across the entire wafer is as uniform as possible.

A CMP process typically entails polishing the wafer surface using a rotating polishing pad and a slurry made from various chemicals and abrasive particulates, so that both chemical and physical removal mechanisms contribute to the planarization. Because the film has a different thickness at different locations on the wafer when it is deposited, it is desired to polish more at some locations on the wafer and less at other locations to achieve a final uniform film thickness on the entire wafer. Because the rotating pad in a conventional polisher system is typically larger than the wafer, changes made to the pad itself tend to affect the wafer as a whole i.e., changes to the pad affect "global uniformity." Such changes are not effective in reducing localized variations in film thickness, or "local uniformity."

As integrated circuit feature sizes shrink below 20 nm, both global and local CMP uniformity requirements become more stringent. If a film is not sufficiently flat across the entire wafer, it may fail to present a surface that remains in focus during a subsequent lithography step. Or, the pre-lithography alignment check may fail, causing a full wafer to be scrapped. Despite such consequences, conventional CMP systems lack the flexibility and the capability to address the local non-uniformity problem. Some compensatory solutions have been introduced at the lithography step. For example, a gas cluster ion beam (GCIB) can be used to treat individual die that have residues from previous steps, or die that have been under-polished. However, at a throughput of less than 10 wafers/hour, GCIB is a very slow and costly operation, and it is thus not a desirable approach to improving local uniformity.

BRIEF SUMMARY

A preferred approach solves local film non-uniformities on the wafer in-situ during the CMP step. One such approach is an adaptive uniform CMP system that uses in-situ thickness uniformity measurements and feedback control to apply localized adjustments during a polishing operation. Such an adaptive uniform polishing system includes a rotatable head that holds a semiconductor wafer and a processing unit structured to be placed in contact with an exposed surface. The processing unit includes a rotatable polishing pad and a plurality of rotatable micro-pads that can polish different portions of the exposed surface at different speeds and pressures. Thus, uniformity across the exposed surface can be enhanced by customizing the treatment of different areas, such as the perimeter of the wafer. Customized treatments can include the use of different polishing pad materials, and different geometries and pad arrangements, in addition to varying the pad motion.

The pressure and rotation speed applied to micro-pads can vary dynamically while in operation. For example, when a micro-pad is at an edge location on the wafer where the layer is thin, the micro-pad may polish at a low pressure. A micro-pad that is at a location where the layer is thicker, the micro-pad can apply more pressure or rotate at a higher speed to remove more material so that the final thin film layer which remains on the wafer has a uniform thickness across the entire wafer. Parameters of the adaptive uniform polishing system are programmable, based on data supplied by a feedback control system. The data can come from the polishing system itself via an in-situ thickness measuring device. A microprocessor computes a thickness profile of the layer being removed and then determines pressure settings needed at various spatial locations to produce a uniformly-polished surface. An algorithm is disclosed that provides for both a global thickness adjustment and a local thickness adjustment.

Additionally or alternatively, the feedback control system data can come from other operations in a fabrication process via an advanced process control system in which in-line metrology data is fed to downstream operations to tailor the downstream processes.

BRIEF DESCRIPTION OF THE SEVERAL VIEWS OF THE DRAWINGS

In the drawings, identical reference numbers identify similar elements. The sizes and relative positions of elements in the drawings are not necessarily drawn to scale.

DETAILED DESCRIPTION

Figure 1:
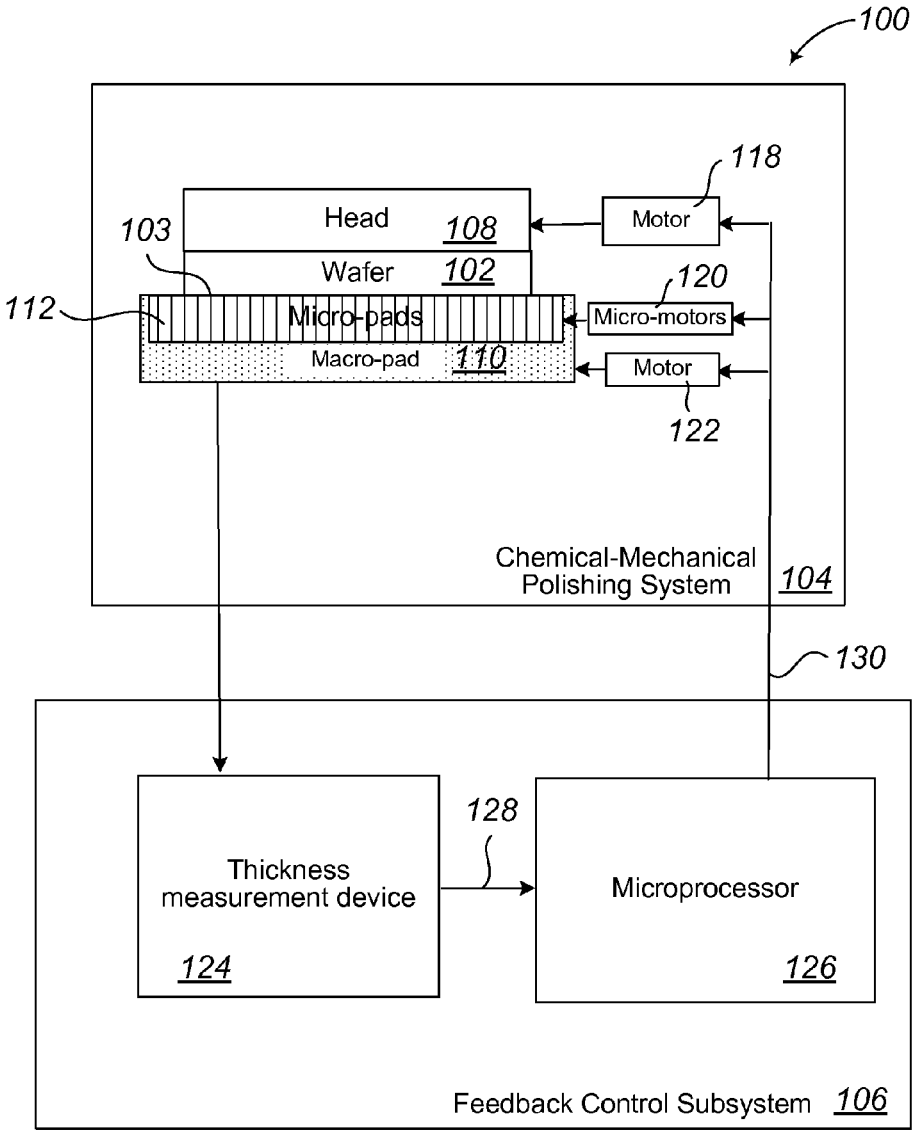
FIG. 1 is a block diagram of an adaptive uniform polishing system according to one embodiment described herein.

In the following description, certain specific details are set forth in order to provide a thorough understanding of various aspects of the disclosed subject matter. However, the disclosed subject matter may be practiced without these specific details. In some instances, well-known structures and methods of semiconductor processing comprising embodiments of the subject matter disclosed herein have not been described in detail to avoid obscuring the descriptions of other aspects of the present disclosure.

Unless the context requires otherwise, throughout the specification and claims that follow, the word "comprise" and variations thereof, such as "comprises" and "comprising" are to be construed in an open, inclusive sense, that is, as "including, but not limited to."

Reference throughout the specification to "one embodiment" or "an embodiment" means that a particular feature, structure, or characteristic described in connection with the embodiment is included in at least one embodiment. Thus, the appearance of the phrases "in one embodiment" or "in an embodiment" in various places throughout the specification are not necessarily all referring to the same aspect. Furthermore, the particular features, structures, or characteristics may be combined in any suitable manner in one or more aspects of the present disclosure.

Reference throughout the specification to integrated circuits is generally intended to include integrated circuit components built on semiconducting substrates, whether or not the components are coupled together into a circuit or able to be interconnected. Throughout the specification, the term "layer" is used in its broadest sense to include a thin film, a cap, or the like.

Reference throughout the specification to conventional thin film deposition techniques for depositing silicon nitride, silicon dioxide, metals, or similar materials include such processes as chemical vapor deposition (CVD), low-pressure chemical vapor deposition (LPCVD), metal organic chemical vapor deposition (MOCVD), plasma-enhanced chemical vapor deposition (PECVD), plasma vapor deposition (PVD), atomic layer deposition (ALD), molecular beam epitaxy (MBE), electroplating, electro-less plating, and the like. Specific embodiments are described herein with reference to examples of such processes. However, the present disclosure and the reference to certain deposition techniques should not be limited to those described. For example, in some circumstances, a description that references CVD may alternatively be done using PVD, or a description that specifies electroplating may alternatively be accomplished using electro-less plating. Furthermore, reference to conventional techniques of thin film formation may include growing a film in-situ. For example, in some embodiments, controlled growth of an oxide to a desired thickness can be achieved by exposing a silicon surface to oxygen gas or to moisture in a heated chamber.

Reference throughout the specification to conventional photolithography techniques, known in the art of semiconductor fabrication for patterning various thin films, includes a spin-expose-develop process sequence typically followed by an etch process. Alternatively or additionally, photoresist can also be used to pattern a hard mask, for example, a silicon nitride hard mask, which, in turn, can be used to pattern an underlying film.

Reference throughout the specification to conventional etching techniques known in the art of semiconductor fabrication for selective removal of polysilicon, silicon nitride, silicon dioxide, metals, photoresist, polyimide, or similar materials includes such processes as wet chemical etching, reactive ion (plasma) etching (RIE), washing, wet cleaning, pre-cleaning, spray cleaning, chemical-mechanical planarization (CMP) and the like. Specific embodiments are described herein with reference to examples of such processes. However, the present disclosure and the reference to certain deposition techniques should not be limited to those described. In some instances, two such techniques may be interchangeable. For example, stripping photoresist may entail immersing a sample in a wet chemical bath or, alternatively, spraying wet chemicals directly onto the sample.

Specific embodiments are described herein with reference to equipment and methods for performing mechanical polishing and/or chemical-mechanical planarization (CMP); however, the present disclosure and the reference to certain materials, dimensions, and the details and ordering of processing steps are exemplary and should not be limited to those shown. The terms "planarize" and "polish" are used synonymously throughout the specification.

In the figures, identical reference numbers identify similar features or elements. The sizes and relative positions of the features in the figures are not necessarily drawn to scale.

FIG. 1 shows an adaptive uniform polishing system 100 intended for use as a CMP module in a semiconductor wafer fabrication process according to embodiments disclosed herein. The adaptive uniform polishing system 100 achieves both global thickness uniformity and local thickness uniformity of a semiconductor wafer 102 through the use of independent micro-pads and feedback control. The semiconductor wafer 102 has an exposed surface 103. The adaptive uniform polishing system 100 includes a chemical-mechanical polishing subsystem 104 and a feedback control subsystem 106. The chemical-mechanical polishing subsystem 104 includes a head 108 configured to hold the semiconductor wafer 102, a macro-pad 110, and micro-pads 112. The micro-pads 112 are structurally integrated with the macro-pad 110. Generally, the head 108, macro-pad 110, and micro-pads 112 are each rotatable about separate axes by motors 118, 120, and 122, respectively. In some applications, the head may or may not rotate. The shape of the macro-pad 110 and the micro-pads 112, however, is desirably circular. The head 108 is desirably designed to hold the semiconductor wafer 102 securely so that the macro-pad 110 and/or the micro-pads 112 can be applied to the exposed surface 103 with a force that is effective in removing material by abrasion of the exposed surface 103, chemical reaction with the exposed surface 103, or both. In one embodiment, the semiconductor wafer 102 is secured to the head 108 by a vacuum chuck. The techniques for securing the wafer on a chuck during CMP are well known in the art.

The semiconductor wafer 102 is further subjected to application of a polishing compound such as a slurry that desirably includes both chemical and particulate components. The particulate component provides an abrasive medium while the chemical component reacts with the surface of the semiconductor wafer 102 to consume material from the exposed surface 103 via one or more chemical reactions. A liquid chemical component may also help to lubricate the abrasive action of the particulates, thereby preventing scratches or gouges. The polishing compound or slurry formulation depends on the material present on the exposed surface 103 of the semiconductor wafer 102. For a semiconductor wafer having a surface in which the exposed film changes often during fabrication of integrated circuits, the chemical is selected based on the composition of the layer. For example, the slurry used to polish a metal surface is different than that used to polish a silicon dioxide or silicon nitride surface. Further details of the various sub-components of the chemical-mechanical polishing system are shown and described below.

The feedback control subsystem 106 includes a thickness measurement device 124 coupled to a microprocessor 126. In one embodiment, the thickness measurement device 124 is capable of measuring the local thickness of surface layers of the semiconductor wafer 102 such as one or more thin films formed on the semiconductor wafer 102. Additionally or alternatively, the thickness measurement device 124 can measure the thickness of the semiconductor wafer 102 itself, or the thickness of a portion of the semiconductor wafer 102, for example, the local thickness of the semiconductor wafer, or the thickness of a metal layer, and so forth.

There are many ways known in the art to measure thickness of a single layer at a local location, including acoustic wave transmission and reflection, optical wave transmission and reflection, mechanical probe, and the like.

The thickness measurement device 124 is coupled communicatively and/or electrically, to the microprocessor 126 so as to provide a feedback signal transmission path 128 for thickness measurement data to be transmitted by the thickness measurement device 124 and received by the microprocessor 126. The thickness measurement data may be in the form of, for example, a spatial thickness profile that describes the exposed surface 103 in detail. The data transmission path 128 can be wired or wireless. The microprocessor 126 is programmed to, for example, evaluate the thickness measurement data, perform computations, compare measurements against selected criteria, and make data-based decisions regarding continued processing of the semiconductor wafer 102. In particular, the microprocessor 126 can be programmed to compute and adjust parameters, such as mechanical settings, derived at least in part from thickness measurements obtained by the thickness measurement device 124. Such mechanical settings can include, for example, pressure settings, rotation directions, and rotation speeds for the macro-pad 110 and for each of the micro-pads 112. Operations of the microprocessor 126 may further include data storage in an on-board memory, or in an external memory.

The microprocessor 126 is communicatively and/or electrically coupled to one or more of the motors 118, 120, and 122 to provide control signals via a control signal data path 130 for adjusting various sub-components of the chemical-mechanical polishing subsystem 104. The control signal data path 130 can be wired or wireless. The motors 118, 120, and 122 are in turn electrically coupled to drive rotating parts including the head 108, the macro-pad 110, and the micro-pads 112, respectively, by turning associated drive units attached to each of the rotating parts. Motors 120 coupled to the micro-pads 112 are small-scale micro-motors such that each micro-pad 112 is independently adjustable via an associated micro-motor 120. In particular, the motors 118, 120, and 122 control rotation directions and rotation speeds of the head 108, macro-pad 110, and micro-pads 112 by actuating their respective drive units, as well as by applying pressure to the semiconductor wafer 102 as a whole, or to certain portions of the exposed surface 103.

Figure 2:
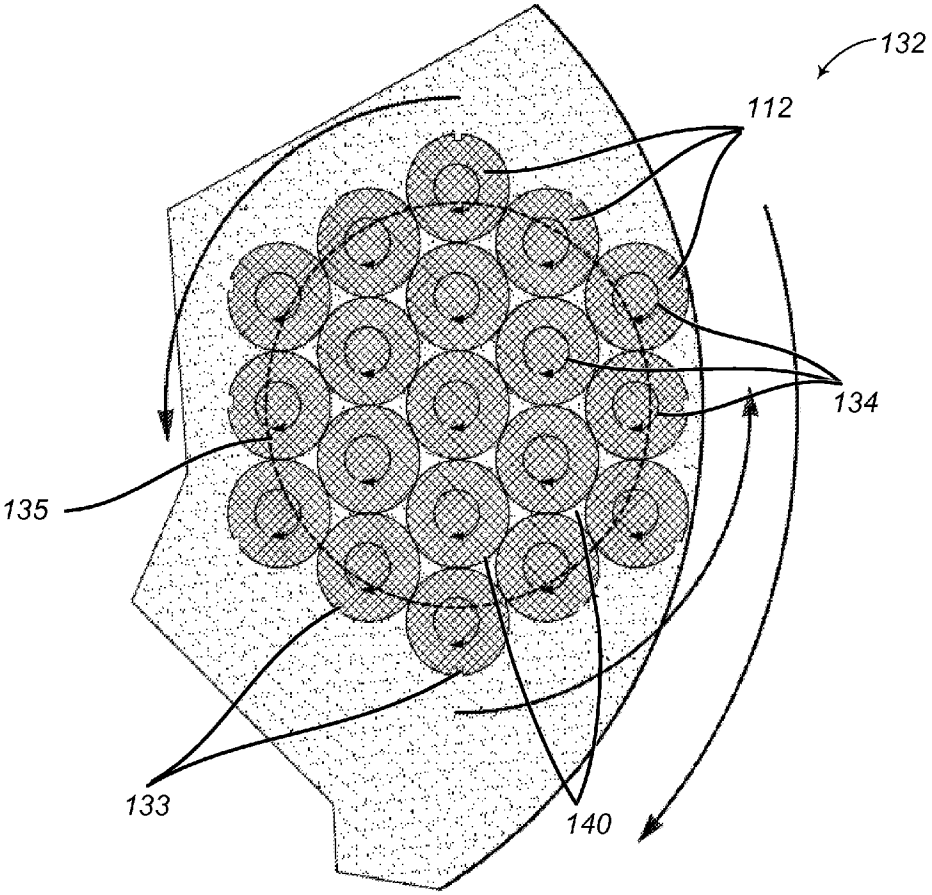
FIG. 2 is a top plan view of an arrangement of micro-pads set to rotate clockwise, with indications of the direction of head rotation, and rotation of a macro-pad.

FIG. 2 shows a top plan view of one embodiment of the CMP subsystem 104 in which circular micro-pads 112 are arranged adjacent to one another in a selected pattern 132. Grooves 133 can be formed at the edges or other locations in the micro-pads 112 to assist in performing a slurry exchange in which used slurry is flushed out of the CMP subsystem and replaced by new slurry. As shown in FIG. 2, only some of the micro-pads 112 include grooves 133. However, in some embodiments, all of the micro-pads 112 can contain grooves 133. The grooves 133 can be formed at boundaries such as along a perimeter or an edge of the micro-pads 112, to provide a flow path between adjacent micro-pads 112.

The micro-pads 112 are placed in contact with the semiconductor wafer 102 so that each micro-pad 112 contacts a different portion of the semiconductor wafer 102. Each of the micro-pads 112 is independently rotatable around a local axis oriented perpendicular to the semiconductor wafer 102. The rotation direction and rotation speed is independently selectable for each of the micro-pads 112. Each of the micro-pads 112 is also independently operable at a different applied pressure. Desirably, the rotation direction, rotation speed, and pressure settings associated with the micro-pads 112 are programmable. Thus, localized control of processing a portion of the semiconductor wafer 102 corresponding to a particular micro-pad 112 is possible. Likewise, localized control of processing a region of the semiconductor wafer 102 corresponding to a particular group of micro-pads 112 is possible, such as, for example, the center of the pattern 132. In addition, a group of micro-pads 112 of particular interest may be the outermost micro-pads 112 that are positioned to intersect a dotted circle 133 representing a constant radius from the center of the macro-pad 110. In one embodiment, the micro-pads are spaced at different distances from the center of the micro-pad arrangement, as shown in FIG. 2. Since the micro-pads are round and abut each other, some of the pads will be closer to the center than other pads, thus forming, in some embodiments, a generally hexagonal or other polygonal type shape of all micro-pads considered as a group. Alternatively, the centers of all of the micro-pads can be at the same distance from the center of the array of micro-pads, thus resulting in a generally circular array of micro-pads.

According to one embodiment as shown in FIG. 2, all of the micro-pads 112 are set to individually rotate at a same time in a common micro-pad rotation direction 134 that is clockwise, as indicated by the individual arrows. Alternatively, the common micro-pad rotation direction 134 around each local axis could be a counter-clockwise rotation. A second arrow indicates rotational motion 136 of the head 108 around a head axis 137 as counter-rotating, or opposing the common micro-pad rotation direction 134. The location of the head 108 that holds the semiconductor wafer 102, relative to the arrangement of micro-pads 112 is represented in FIG. 2 as a dotted circle 135. A third arrow indicates rotational motion 138 of the macro-pad 110 around a macro-pad axis 139 as opposing the rotational motion 136 of the head 108, but aligned with the common micro-pad rotation direction 134. In the embodiment shown in FIG. 2, interstitial areas 140, located between the micro-pads 112, are not empty. The interstitial areas 140 are filled with the material of the macro-pad 110, which remains in-between holes in the macro-pad 110 that are cut out to accommodate the micro-pads 112. This is shown in more detail below, in FIGS. 4A-4B. Areas of the semiconductor wafer 102 that coincide with the interstitial areas 140, located between the micro-pads 112, can be processed by shifting alignment of the macro-pad 110 slightly, relative to the head 108 which holds the semiconductor wafer 102.

Figure 3:
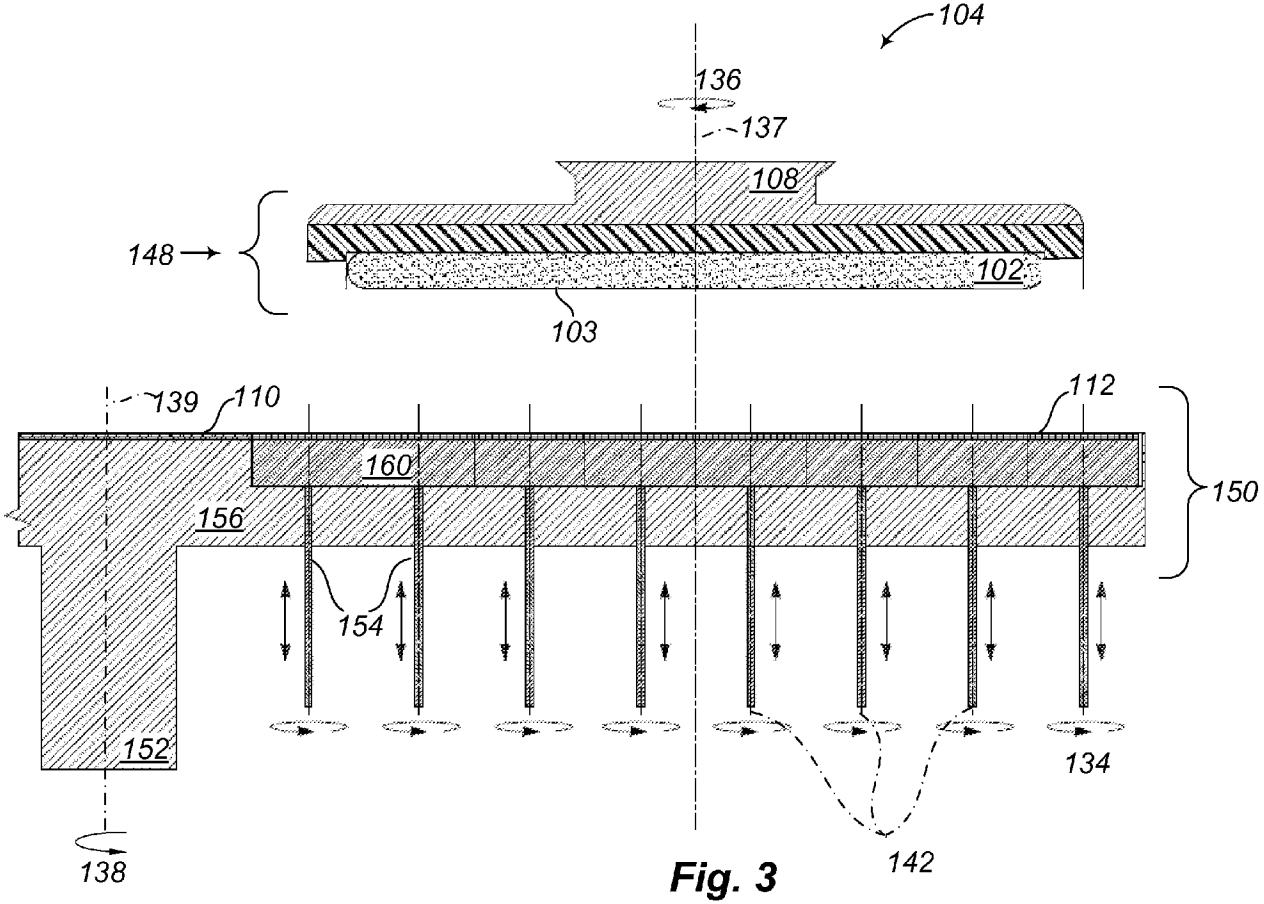
FIG. 3 is a cross-sectional view of the CMP subsystem shown in FIG. 1.

FIG. 3 illustrates operation of the CMP subsystem 104. The head 108 and the semiconductor wafer 102 together can be characterized as a semiconductor wafer unit 148, while the macro-pad 110 together with the micro-pads 112 can be characterized as a CMP pad drive unit 150. In one embodiment, the CMP pad drive unit 150 is sized and dimensioned to be larger overall than the semiconductor wafer unit 148, while individual micro-pads 112 are sized and dimensioned to be substantially smaller than the semiconductor wafer 102. If the semiconductor wafer 102 has a diameter of 300 mm, for example, the macro-pad 110 may be about 1½ to 3 times the wafer size, or as much as 900 mm in diameter. For such an application, the micro-pads 112 may be sized in the range of about 10-300 mm. Alternatively, the macro-pad 110 may be of similar size to the semiconductor wafer unit 148, or smaller than the semiconductor wafer unit 148.

In the exemplary operational scheme shown, the rotational motion 136 of the semiconductor wafer unit 148 around the head axis 137 opposes the common micro-pad rotation direction 134 around micro-pad axes 142. Meanwhile, the rotational motion 138 of the macro-pad 110 aligns with the common micro-pad rotation direction 134, around a macro-pad axis 139. As shown, the head axis 137 is displaced from the macro-pad axis 139 due to the difference in radius between the macro-pad and the semiconductor wafer unit 148, though in other embodiments, the two axes of rotation may be aligned.

In one mode of operation, the CMP drive unit 150 can first start to rotate as described above, and while the pads are rotating, the CMP drive unit 150 and the semiconductor wafer unit 148 can move towards each other along the macro-pad axis 139 until contact is established with the exposed surface 103. Alternatively, the CMP drive unit 150 can first be placed in contact with the exposed surface 103, and then the macro-pad and micro-pads can be set in motion. The CMP drive unit 150 can exert pressure against the exposed surface 103 via a central drive unit 152, and independently, via individual drive units 153. Pressure applied to the macro-pad 110 can be different from that applied to the micro-pads 112, individually. Furthermore, pressure applied to each of the micro-pads 112 can be separately programmed. Similarly, rotation speed of the macro-pad 110 and of the micro-pads 112, collectively or individually, can be independently programmed.

The general structure of CMP drive units is known in the art. A CMP drive unit typically includes a CMP platen to which a pad is attached. In the inventive embodiments, there is a corresponding macro-platen 156 to which the macro-pad 110 is attached. Further, in the inventive embodiments there are a plurality of micro-platens 160 to which respective micro-pads 112 are attached. A CMP machine thus equipped with micro-pads 112 permits operation in a local polish mode. In the local polish mode shown in FIG. 3, when the semiconductor wafer unit 148 is aligned with the micro-pads 112, only the micro-pads 112 come in contact with the wafer surface 103. The macro-pad 110 does not contact the wafer surface 103 in local polish mode and does not rotate about axis 193. Rather the shaft 152 is held stationary with the wafer 102 in contact with only the micro-pads 112. The micro-pads 112 are mounted on the individual micro-platens 160, as shown in further detail in FIGS. 4A and 4B. In the embodiment of FIG. 3, the micro-pads 112 extend slightly outward, beyond the surface of the macro-pad 110, and thus the macro-pad 110 generally does not contact the wafer surface 103. In this embodiment of FIG. 3, it is permitted to have the micro-platens 160 that carry the micro-pads 112 sit on top of, or extend from, the macro-platen 156, so that the macro-pad 110, although present, need not be used at all times.

Figure 4A:
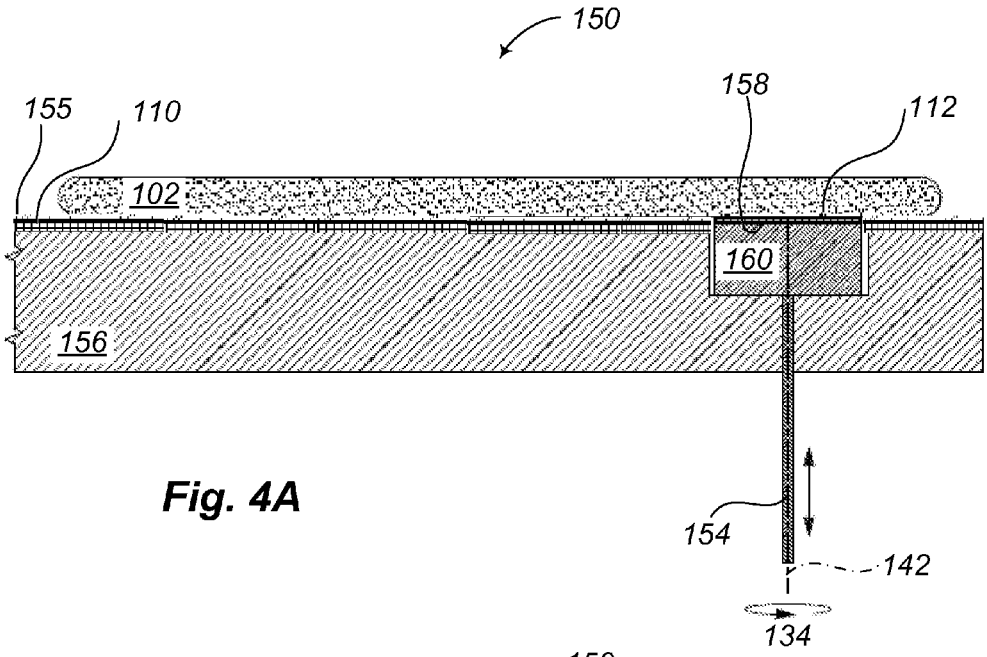
FIG. 4A is a detailed cross-sectional view of a micro-pad/micro-platen assembly in an extended position relative to a macro-platen.
Figure 4B:
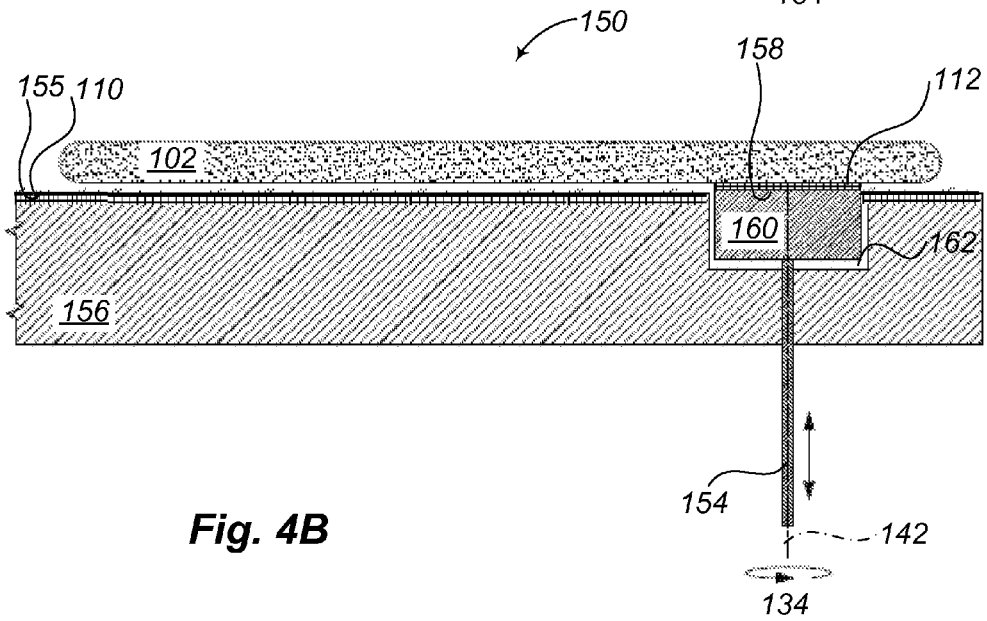
FIG. 4B is a detailed cross-sectional view of a micro-pad/micro-platen assembly in a retracted position relative to a macro-platen.

FIGS. 4A and 4B show in more detail how the micro-pads 112 are structurally integrated with the macro-pad 110 within the CMP drive unit 150. A single micro-pad arrangement is illustrated for simplicity. The macro-pad 110 adheres to a front face 155 of the macro-platen 156. Likewise, each micro-pad 112 adheres to a front face 158 of each micro-platen 160. Adhesion of the pads to the platens may be at least partly achieved by an adhesive applied to the pad such that the pad is removably attached to the platen. The pads are generally consumable supply items that are routinely replaced after a certain number of polishing operations. Adhesion of the pads to the platens may be at least partly achieved by a surface feature of the platens, for example, a rough surface, surface protrusions, surface features that insert into holes in the back of the pad, and the like. The front face 155 of the macro-platen 156 is positioned to receive and hold the macro-pad 110, and each micro-platen 160 has a front face 158 to receive the micro-pad 112.

FIG. 4A illustrates operation in a global polish mode, in which the micro-pads may or may not rotate. In the global polish mode, the micro-pads 112 are rotatably coupled to the macro-pad such that the micro-pads 112 do not rotate independently, but instead they act as part of the macro-pad 110. When operated in the global polish mode, the micro-pads 112 can occupy a recessed area 162 of the macro-platen 156 when not in use. The micro-platen 160 is recessed into the macro-platen 156 so that when the respective pads are attached to each of the macro-pads and micro-pads, the polishing surfaces are coplanar, or flush with each other, as shown in FIG. 4A. In some embodiments, the recessed micro-pads are stationary relative to the macro-pad and thus can be considered part of the macro-pad in those embodiments. The macro-platen rotates about axis 139 and CMD is carried out using standard, well-known techniques. The semiconductor wafer 102 need not be aligned with the micro-pads in the global polish mode. When the micro-pads 112 are programmed to rotate together with, as a part of the macro-pad 110, for example, in the configuration shown in FIG. 2, the micro-pads 112 may remain in contact with the macro-pad 110 and the macro-platen 156.

FIG. 4B illustrates operation in a local polish mode, in which the arrangement of micro-pads 112 is aligned with the semiconductor wafer 102 to provide customized polishing for different areas of the wafer 102. In the local polish mode, the micro-pads 112 can be programmed to rotate differently from the macro-pad 110. Each one of the micro-pads 112 has a micro-platen drive rod 154, separate from the macro-platen drive rod 152. In local polish mode, the micro-platen drive rods 154 can extend above the macro-pad surface 155 to an elevated position where the micro-pads 112 can rotate freely. Alternatively, the micro-pads 112 can rotate freely within the recessed area 162, as shown in FIG. 4A, by applying pressure to the micro-platen drive rod 154. Usually the rotation of the macro-pad 155 about axis 139 will be stopped when the device is in the local polish mode.

FIGS. 5, 6, 7A-7C, and 8 show different embodiments of the adaptive uniform polishing system and, in particular, different configurations for the micro-pads 112.

Figure 5:
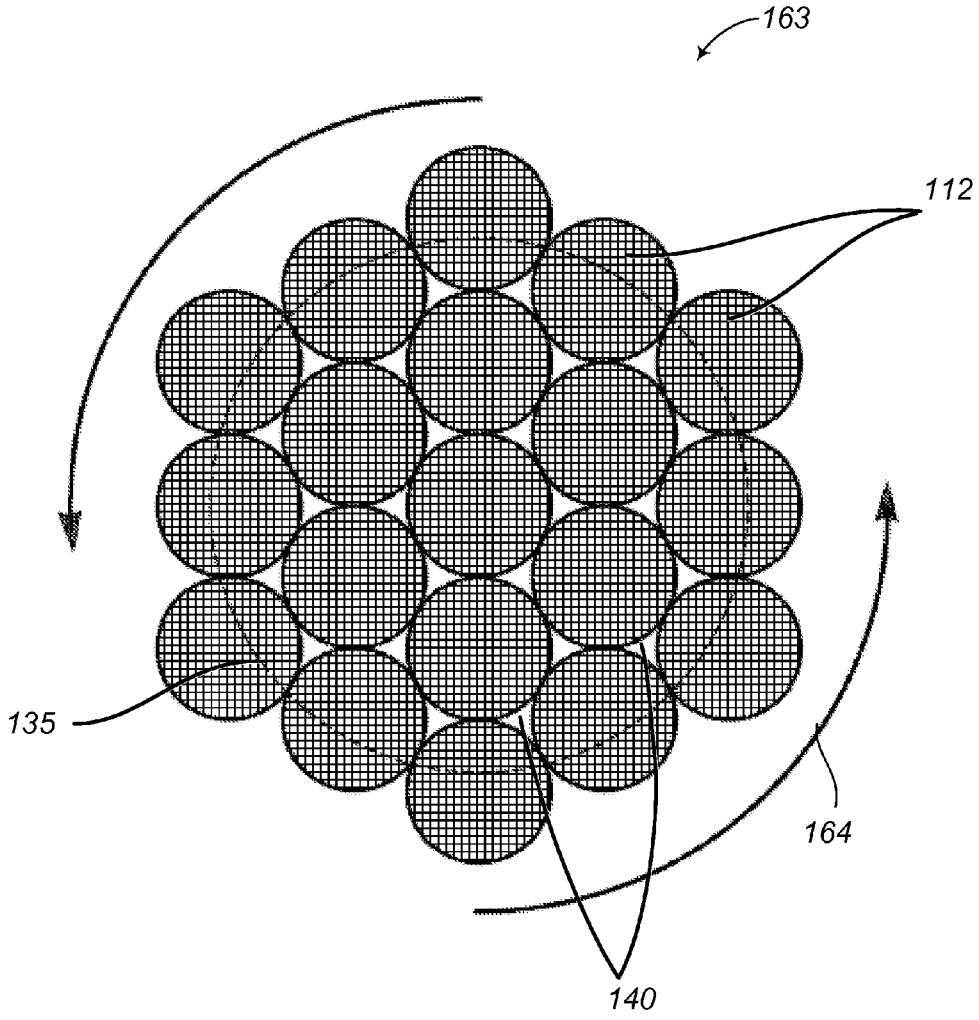
FIG. 5 is a top plan view of an arrangement of micro-pads made of the same material, rotating together in a counter-clockwise direction.

FIG. 5 shows a uniform micro-pad configuration 163 in which all of the micro-pads 112 are made of the same material and they are set to rotate together as a single unit, coupled with the surrounding macro-pad, for example, in a clockwise direction 164. Such motion corresponds to the global polish mode described above. The material used to make the micro-pads 112 can be the same as or different from that used to make the macro-pad 110.

Figure 6:
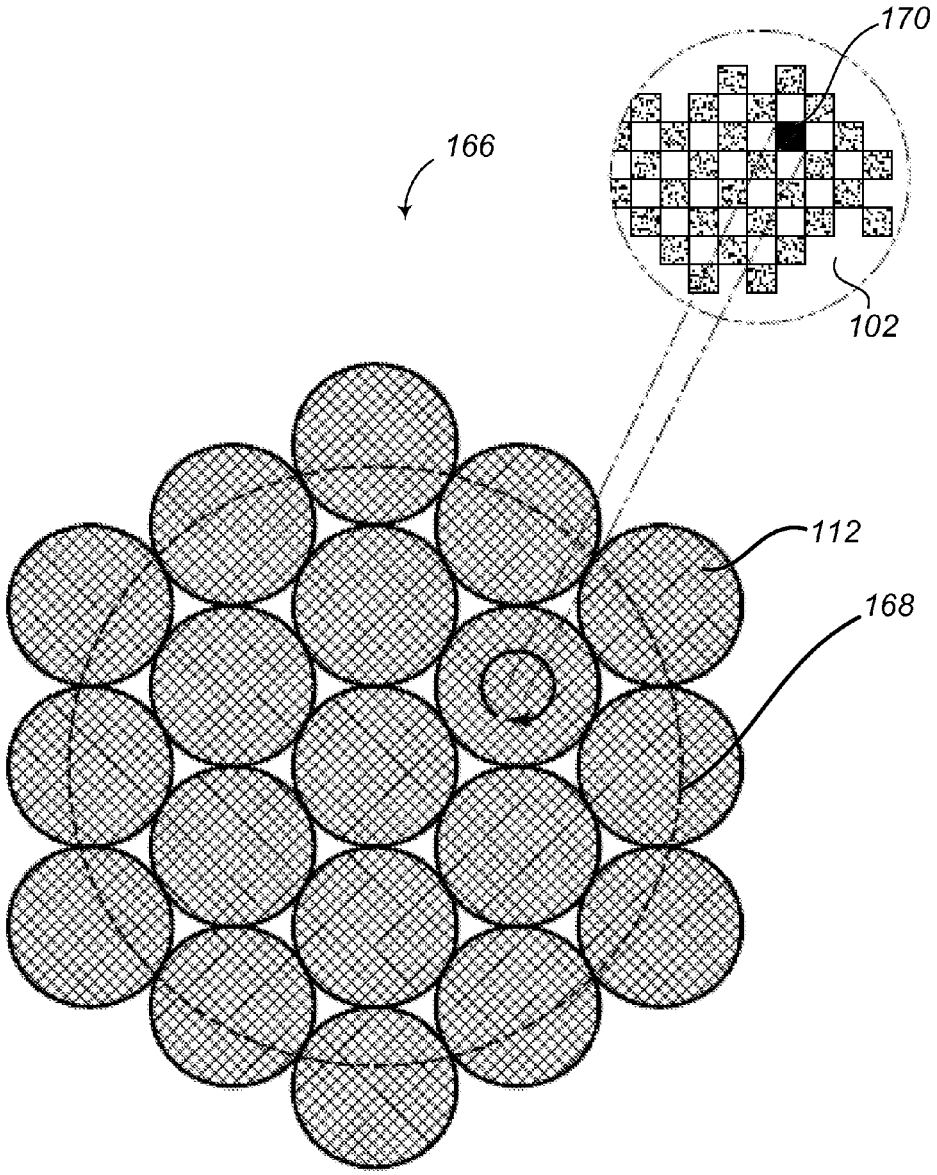
FIG. 6 is a top plan view of an arrangement of micro-pads in which one micro-pad applies a customized treatment to a corresponding area of a semiconductor wafer.

FIG. 6 shows a tailored micro-pad configuration 166 in which a single, particular micro-pad 168 is programmed to rotate differently than the other micro-pads 112. Differences in rotational motion can be achieved by modifying mechanical parameter values that govern applied pressure and rotation characteristics of each particular micro-pad 112, as controlled by the micro-motors 120. For example, the particular micro-pad 168 is one of the plurality of micro-pads 112, and it may be programmed to rotate opposite to a rotation direction of the other micro-pads 112. Or, the particular micro-pad 168 may be the only micro-pad programmed to rotate while the other micro-pads, the macro-pad 110, and the head 108 remain fixed, without rotation.

The tailored micro-pad configuration 166 can be used, for example, in the local polish mode, to apply a special treatment to a specific area 170, such as a single die on the semiconductor wafer 102. Such a special treatment may be desirable if, for example, it is known that the specific area 170 is prone to defects, or to a specific defect type. Alternatively, a special treatment may be desirable if an in-line metrology step detects a defect at a specific area 170 that can be corrected by modifying the polish operation at the specific area 170. Using an advanced process control scheme, data from the in-line metrology step can then be forwarded to a subsequent polish operation. Upon receipt of advanced process control data for a certain semiconductor wafer 102, the adaptive uniform polishing system 100 can be re-programmed accordingly to address the specific area 170 by adjusting the pressure, rotation direction, or rotation speed of the particular micro-pad 168 that corresponds to the specific area 170.

Figure 7A:
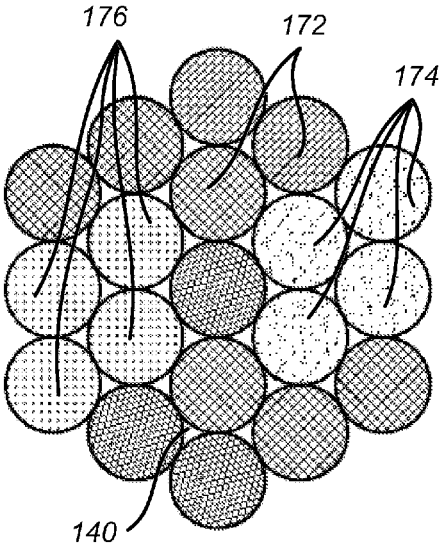
FIG. 7A is a top plan view of an arrangement of micro-pads made of different materials, for use in the adaptive uniform polishing system described herein.
Figure 7B:
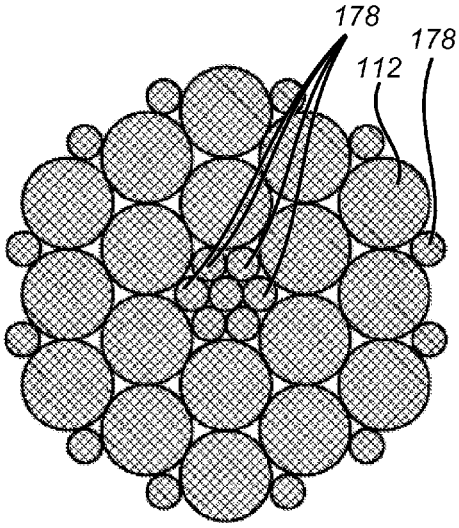
FIG. 7B is a top plan view of an arrangement of micro-pads of different sizes for use in the adaptive uniform polishing system described herein.
Figure 7C:
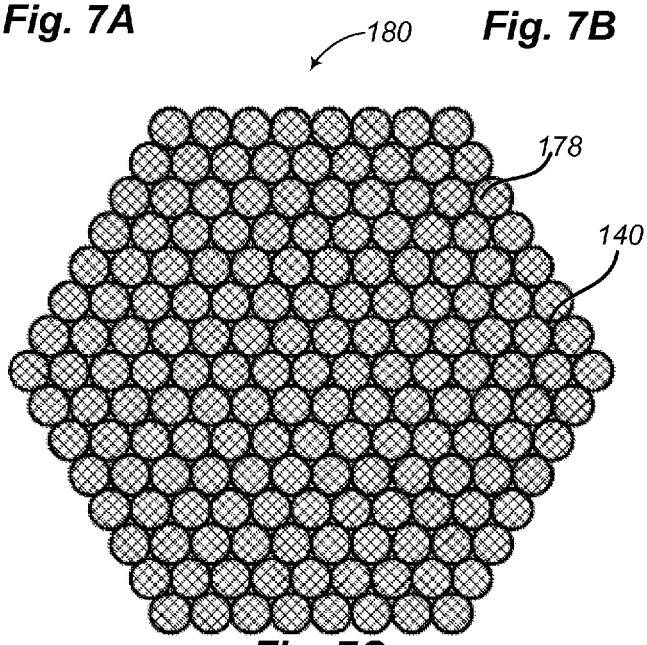
FIG. 7C is a top plan view of a hexagonal arrangement of small micro-pads for use in the adaptive uniform polishing system described herein.

FIGS. 7A-7C show a few examples of different arrangements of the micro-pads 112 that can be used with the adaptive uniform polishing system 100.

As indicated in FIG. 7A by the use of different fill patterns, adjacent ones of the micro-pads 112 can be made of different materials as shown at 172. Alternatively, a first group of the micro-pads 112 can be made of one material 174 while another group is made of another material 176. It may be advantageous for some or all of the edge micro-pads to be made of a different material, or for the center micro-pad to be made of a special material. Such flexibility provides an additional variable that can control center-to-edge uniformity of the polish process, or that can compensate for poor center-to-edge uniformity at a previous step in the overall fabrication process.

In the semiconductor industry, conventional macro-pads 110 are typically made of polymers of varying stiffness. Stiffness of the material used to make macro-pads 110 can be varied by changing pore characteristics of the polymer structure such as pore size, pore density, and the like. A material that contains large, open pores generally produces a softer pad that results in improved defect removal. A material that contains small, closed pores generally produces a stiffer pad that results in better polish uniformity but incurs more defects. Vendors typically offer IC manufacturers a range of about 6-10 different polymer pad types having different degrees of stiffness.

Thus, there is an advantage in equipping a CMP system with a micro-pad apparatus that can be flexibly configured with pad materials of varying stiffness for use in different areas of the wafer. Herein, the term "different material" can refer to polymer materials having different properties, for example, different degrees of stiffness). So, in one embodiment, the different materials 174 and 176 may be, for example, hard and soft pad materials, respectively, for use in flexibly adjusting uniformity and defect performance at different locations on the same exposed surface 103. In some embodiments, micro-pads and/or the macro-pad can be made of non-polymer materials or hybrid materials.

While the micro-pads made of different materials are shown at various locations in FIG. 7A, in some embodiments they are positioned at selected locations to achieve a desired polish pattern. For example, all micro-pads 112 at the perimeter edge will be made of a first material, to perform a certain edge polish function, while micro-pads in the center have a different roughness and are made of a different material.

As indicated in FIG. 7B the micro-pads 112 can be of non-uniform size. For example, the center of the semiconductor wafer 102 can be processed using a group of small micro-pads 178 to allow for even greater localized control in treating the exposed surface 103. Similarly, the edge of the semiconductor wafer 102 can be processed using a combination of standard micro-pads 112 and small circular micro-pads 178 as shown. The small micro-pads 178 can be made to approximately match a certain die size, for example. Accordingly, each small micro-pad 178 has an associated micro-motor 120 to control rotation and pressure of the micro-pad 178. The smaller the micro-pad size, the larger the number of micro-pads is needed to cover the exposed surface 103, and the more micro-motors need to be added to the CMP subsystem 104.

As indicated in FIG. 7C, an arrangement of micro-pads 180 may include only the small micro-pads 178. Smaller unit sizes allow for a wider variety of arrangements of the micro-pads 178. Another advantage of the small micro-pads 178 is that the interstitial areas 140 become smaller as coverage of the exposed surface 103 of the semiconductor wafer 102 by the micro-pads increases. In general, micro-pads 178 that have a small unit size allow for a greater degree of localized control, and therefore smaller micro-pads 178 are generally more advantageous than larger micro-pads in achieving cross-wafer uniformity.

The micro-pads 112 can be organized in a hexagonal arrangement as shown in FIG. 7C, and partially shown in FIG. 5, if desired. The micro-pads 112 are positioned on the macro-pad 110 at the location that passes through a central region of the wafer (see, for example, the embodiment of FIG. 8).

Figure 8:
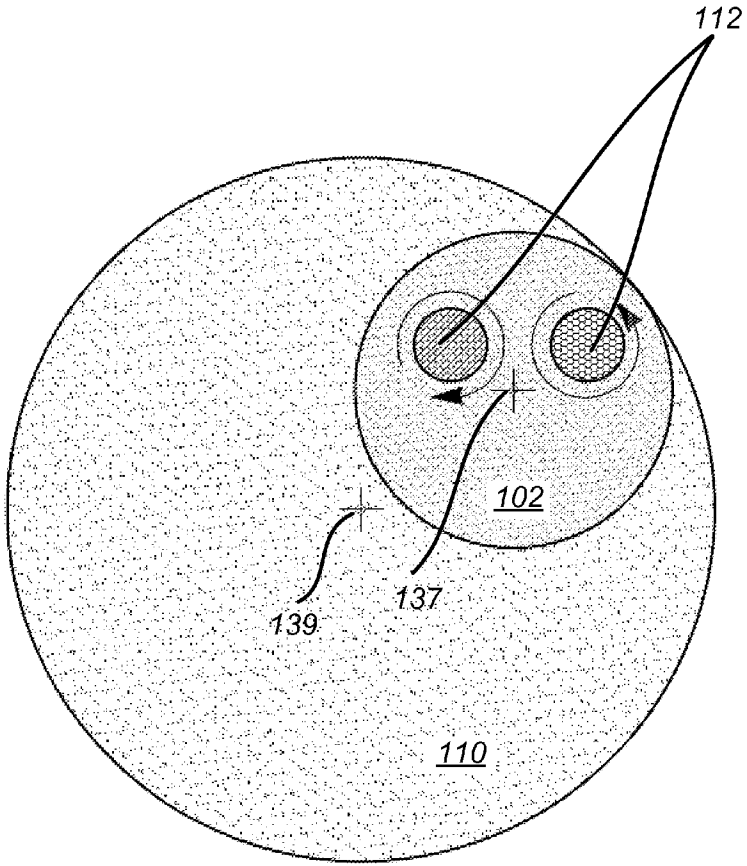
FIG. 8 is a top plan view of an exemplary processing unit configured with a large macro pad and two counter-rotating micro-pads.

FIG. 8 shows a top view of the wafer 102 positioned on the macro-pad 110. The macro-pad 110 rotates about the macro-pad axis 139, the micro-pads rotate about their axis 142, and the wafer rotates about axis 136. The micro-pads are shown in dotted lines because they will be covered by the wafer 102 when seen from a top view. Only two micro-pads 112 are shown, but there will usually be at least 7-15 micro-pads, as shown in the prior figures.

FIG. 8 shows an embodiment in which the macro-pad 110 is sized much larger than the semiconductor wafer 102 so that the semiconductor wafer 102 can be moved relative to the macro-pad 110 to receive different types of processing. The semiconductor wafer unit 148 can move to an area of the macro-pad 110 that includes an arrangement of one or more micro-pads 112. For example, an area of the macro-pad 110 can be equipped with two micro-pads 112 that are made of different materials, as shown. Furthermore, the micro-pads 112 can be made to rotate in opposite directions as shown, and/or at different rotation speeds, or they may exert different pressures when they contact the semiconductor wafer 102. Whereas, if the semiconductor wafer unit 148 contacts any other part of the macro-pad 110, the semiconductor wafer 102 receives a standard process that does not involve the use of micro-pads 112. Thus, at one step in a fabrication process, a semiconductor wafer 102 can receive standard processing, when the pad 110 rotates as a whole, and later at another layer it can receive specialized processing by the same equipment, without having to change the polish pad configuration. This special processing is carried out while pad 110 is stationary and only the micro-pads 112 rotate. Or, one wafer in a lot can receive specialized processing while another receives standard processing.

Figure 9:
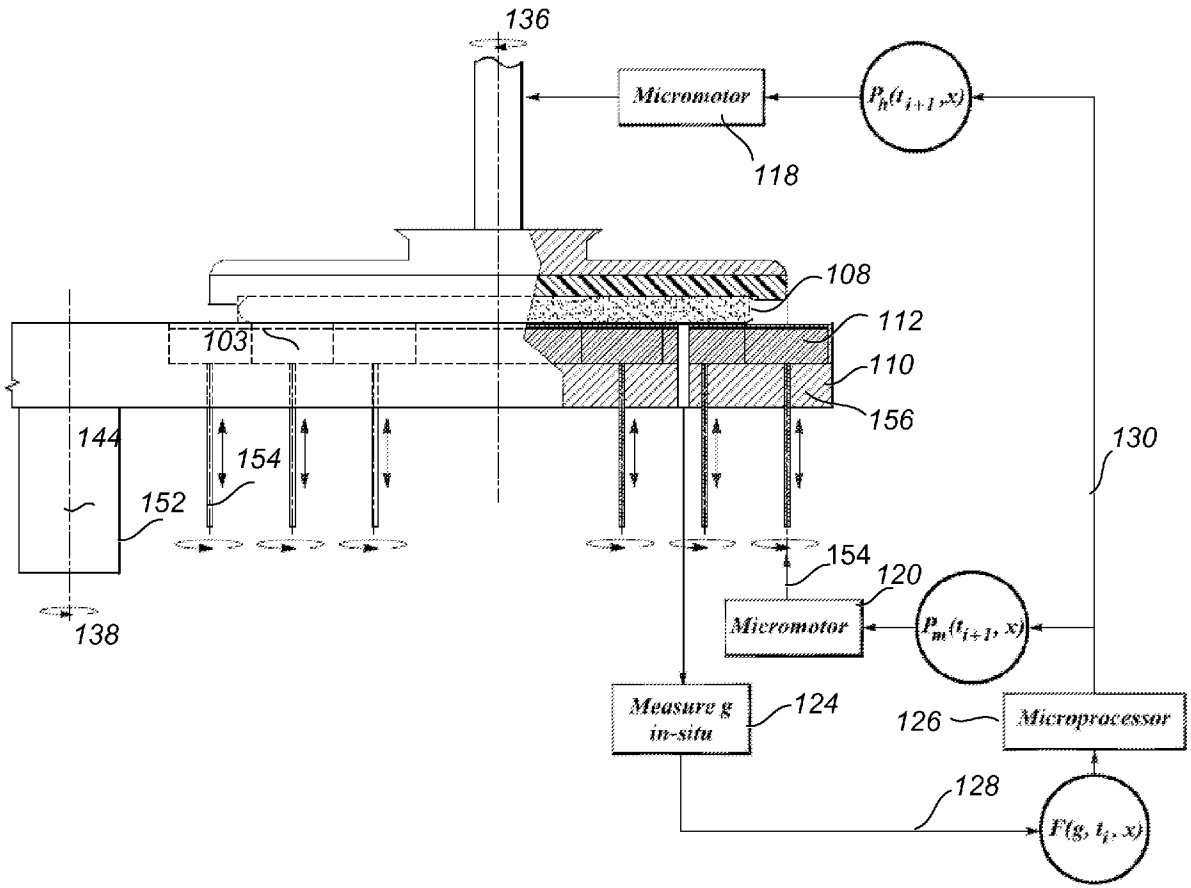
FIG. 9 is a cross-sectional view of the adaptive uniform polishing system shown in FIG. 1, including a detailed block diagram of the feedback control subsystem.

Operation of an exemplary embodiment of the feedback control subsystem 106 is shown and described below with reference to FIGS. 9 and 10. FIG. 9 shows the adaptive uniform polishing system 100 in cross-section, operating with the feedback control subsystem 106, including the thickness measurement device 124. Also indicated are three electronic signals that are functions of time (t) and position (x), or location on the semiconductor wafer 102: a feedback signal $F_i(g,t,x)$, which is an input to a programmable correction unit such as the microprocessor 126, and global and local pressure control signals, which are computed settings output from the microprocessor 126: $P_h(t_{i+1},x)$ and $P_m(t_{i+1},x)$, respectively. $P_h(t_{i+1},x)$ controls pressure applied to the head 108 via the head motor 118. $P_m(t_{i+1},x)$ controls pressure applied to the micro-pads 112 via one or more of the micro-motors 120. The feedback signal $F_i(g,t,x)$ is a global thickness profile g (t, x), obtained from the thickness measurement device 124.

Figure 10:
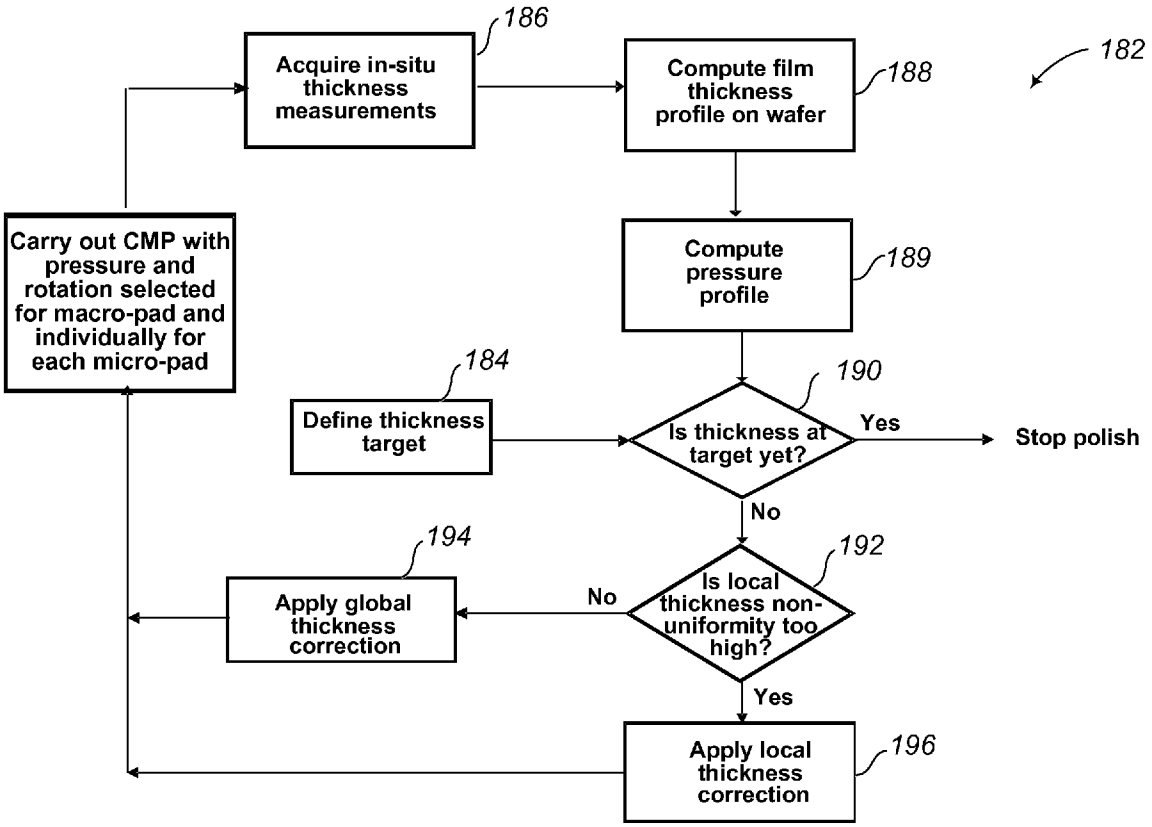
FIG. 10 is a flow diagram showing a sequence of steps in a feedback control algorithm that can be used to adjust parameters of the adaptive uniform polishing system.

FIG. 10 illustrates a feedback control algorithm 182 that implements an adaptive method of polishing a semiconductor wafer. The feedback control algorithm 182 can be programmed for execution by the microprocessor 126 to generate the control signals $P_h(t_{i+1},x)$ and $P_m(t_{i+1},x)$, according to one embodiment. The global control signal $P_h(t_{i+1},x)$ is then communicated to the motor 118 that drives the head 108, and the local control signal $P_m(t_{i+1},x)$ is communicated to the micro-motors 120 that drive the micro-pads 112.

At 184, a global target thickness is defined as $(\overline{Th_i(x)})$.

At 186, thickness measurements are acquired in-situ from the semiconductor wafer 102 using the thickness measurement device 124. Alternatively, thickness measurements can be acquired from other sources, for example, from in-line metrology equipment. For example, advanced process control (APC) monitoring may indicate a systematic defect or irregularity that could be improved with different or additional polishing at a specific wafer location. Such data can be used in place of, or in addition to, the in-situ thickness measurement data, to make adjustments to the polishing operation.

At 188, a thickness measurement profile is computed and sent as a feedback signal $F_i(g,t,x)$ to the microprocessor 126 for comparison against the target thickness. The thickness measurement profile can be computed by the thickness measurement device 124, or the thickness data can be sent to the microprocessor 126, and the thickness measurement profile can be computed by the microprocessor.

At 189, the thickness measurement profile is translated into a pressure profile P(g,t,x).

At 190, the microprocessor 126 analyzes the thickness measurement profile to determine if the target thickness has been reached. If g is at or below the global target thickness, polishing is stopped.

At 192, if g exceeds the global target thickness, the local thickness uniformity is checked against a uniformity target.

At 194, if the local thickness uniformity does not exceed the uniformity target, a global thickness adjustment is applied at time i+1 at location x, via an applied pressure $P_i(t_{i+1},x)$ that can be computed according to the Preston equation:

$$P_i(t_{i+1},x)=\overline{P_i(t_i,x)}+\Delta P_i(t_i,x), \tag{1}$$

in which the average pressure at a time $t_i$ is given by $$\overline{P_i(t_i,x)}=\mathrm{AVG}[(Th_0(x)-Th_i(x))/(t_i-t_0)(K_pV)] \tag{2}$$

and a pressure adjustment at a time $t_i$ is given by $$\Delta P_i(t_i,x)=(Th_i(x)-\overline{Th_i(x)})/(t_i-t_0)(K_pV). \tag{3}$$

In equations (2) and (3), $K_p$ is the Preston constant, V is the wafer pad velocity, $(\overline{Th_i(x)})$ is the average film thickness measured at time $t_i$, $Th_0(x)$ is the initial film thickness measured at time $t_0$ and position x, and $Th_i(x)$ is the film thickness measured at time $t_i$ and position x.

At 196, if the local thickness uniformity is too high, a local thickness adjustment is applied via the micro-pads 112. For a configuration having n micro-pads, the thickness profile g can be divided into local measurements $g_1-g_n$, to represent areas of the semiconductor wafer corresponding to the areas of each of the micro-pads 112. If the local thickness exceeds the target, the corresponding micro-pad can be activated to continue polishing the corresponding area of the exposed surface 103. Thus, the feedback control subsystem 106, coupled with the micro-pads 112, provide for automatic adjustments within the polishing module of a multi-step fabrication line.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

It will be appreciated that, although specific embodiments of the present disclosure are described herein for purposes of illustration, various modifications may be made without departing from the spirit and scope of the present disclosure. Accordingly, the present disclosure is not limited except as by the appended claims.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A system configured to uniformly planarize a semiconductor wafer, the system comprising:

a head configured to hold the semiconductor wafer; and a pad drive unit structured to retain a plurality of polishing pads, the pad drive unit including:

a plurality of micro-pads adjacent to one another, the micro-pads positioned to be placed in physical contact with different portions of an exposed surface of the semiconductor wafer, each micro-pad independently rotatable around a local axis;

a macro-pad positioned to be placed in physical contact with the exposed surface of the semiconductor wafer, the macro-pad and the plurality of micro-pads having co-planar polishing surfaces: and a plurality of drive units, each drive unit coupled to a respective micro-pad.

2. The system of claim 1 wherein the head is rotatable around a head axis and the macro-pad is rotatable around a macro-pad axis.

3. The system of claim 2 wherein the head is operable to rotate in a rotation direction opposite that of the macro-pad.

4. The system of claim 2 wherein rotation of the macro-pad is in a direction opposite the rotation direction of one or more micro-pads.

5. The system of claim 2 wherein the micro-pads are rotatably coupled to the macro-pad.

6. The system of claim 2 wherein the macro-pad and each of the micro-pads is independently operable at a different rotation speed.

7. The system of claim 2 wherein the macro-pad and each of the micro-pads is independently operable to rotate in either a clockwise or a counterclockwise direction.

8. The system of claim 2 wherein the micro-pads are operable to rotate together in a common micro-pad rotation direction.

9. The system of claim 2 wherein the head axis and the macro-pad axis are aligned.

10. The system of claim 2, further comprising an adaptive feedback control system that includes:

an in-situ film thickness measuring device configured to measure a thickness of a layer of material on the semiconductor wafer;

a microprocessor programmed to compute and adjust settings derived at least in part from film thickness measurements; and a plurality of motors operable to cause rotation around the head axis, the macro-pad axis, and the local axes, and to apply pressure to the macro-pad and the micro-pads in accordance with the computed settings, to adjust processing of localized regions of the semiconductor wafer.

11. The system of claim 10 wherein the thickness measurements include a thickness profile, and the computed settings include one or more of a pressure profile, an average pressure, a rotation direction, or a rotation speed.

12. The system of claim 10, further comprising a programmable correction unit that adjusts parameters of the macro-pad and the micro-pads in response to the thickness measurements.

13. The system of claim 1 wherein the macro-pad and each of the micro-pads is independently operable at a different applied pressure.

14. The system of claim 1, suitable for use with a chemical polishing agent.

15. The system of claim 1 wherein the macro-pad is made from a first material and one or more of the micro-pads are made from materials that differ from the first material.

16. The system of claim 1 wherein the micro-pads are integrated with the macro-pad.

17. The system of claim 1 wherein each micro-pad is removably attached to a micro-platen.

18. The system of claim 1 wherein the macro-pad is removably attached to a macro-platen.

19. The system of claim 1, further comprising grooves formed in at least some of the micro-pads.

20. The system of claim 1 wherein sizes of the micro-pads are non-uniform.

21. The system of claim 1 wherein the macro-pad is circular.

22. The system of claim 1 wherein the macro-pad is hexagonal.

* * * * *

UNITED STATES PATENT AND TRADEMARK OFFICE

CERTIFICATE OF CORRECTION

PATENT NO. : 9,162,339 B2
APPLICATION NO. : 14/035281
DATED : October 20, 2015
INVENTOR(S) : John H. Zhang It is certified that error appears in the above-identified patent and that said Letters Patent is hereby corrected as shown below:

On the Title Page:

Item (71):
"STMicroelctronics, Inc., Coppell, TX (US)" should read, --STMicroelectronics, Inc., Coppell, TX (US)--.

Signed and Sealed this
Twenty-eighth Day of June, 2016

Michelle K. Lee

Michelle K. Lee
*Director of the United States Patent and Trademark Office*